United States Patent [19]

Karraker

[11] 4,331,114

[45] May 25, 1982

[54] AUXILIARY ENGINE STOPPAGE APPARATUS

[75] Inventor: David O. Karraker, Decatur, Ill.

[73] Assignee: Caterpillar Tractor Co., Peoria, Ill.

[21] Appl. No.: 261,100

[22] PCT Filed: Oct. 1, 1980

[86] PCT No.: PCT/US80/01299

§ 371 Date: Oct. 1, 1980

§ 102(e) Date: Oct. 1, 1980

[51] Int. Cl.[3] ..... F02B 77/08; F02D 1/00

[52] U.S. Cl. ..... 123/198 DB; 123/365; 123/367; 123/332; 123/397

[58] Field of Search ..... 123/198 D, 198 DB, 365, 123/367, 372, 373, 374, 332, 397

[56] References Cited

U.S. PATENT DOCUMENTS

| | | | |
|---|---|---|---|
| 2,719,521 | 10/1955 | King et al. | 123/198 DB |
| 2,854,964 | 10/1958 | Wagner | 123/198 DB |
| 3,237,478 | 3/1966 | Jewell | 123/198 DB |
| 3,603,300 | 9/1971 | Moffett | 123/198 DB |
| 3,640,258 | 2/1972 | Isobe et al. | 123/365 |
| 3,865,090 | 2/1975 | Masters et al. | 123/198 DB |
| 4,072,332 | 2/1978 | Isaia | 292/228 |
| 4,108,129 | 8/1978 | Rognon | 123/198 DB |

FOREIGN PATENT DOCUMENTS

| | | | |
|---|---|---|---|
| 557902 | 8/1953 | Canada | 123/198 DB |
| 951808 | 3/1964 | United Kingdom . | |
| 1164165 | 9/1969 | United Kingdom . | |
| 1253322 | 11/1971 | United Kingdom . | |
| 1373086 | 11/1974 | United Kingdom | 123/198 DB |
| 1465121 | 2/1977 | United Kingdom . | |

*Primary Examiner*—Ira S. Lazarus
*Attorney, Agent, or Firm*—Joseph W. Keen

[57] ABSTRACT

Apparatus (10) for stopping an engine from a remote location relative to an operator's work station. An engagement apparatus (20) which is displaceable between first and second positions is engaged with an engine stoppage member (19) which, when rotatably displaced by the engagement apparatus (20) between two positions corresponding to the first and second positions of the engagement apparatus (20), can permit engine operation or induce engine shutdown. An actuating link (24) interconnected with engagement apparatus (20) is displaceable, when subjected to a momentarily applied external force, between engine operating and engine shutdown positions. A spring (30) biases engagement apparatus (20) towards the first and second positions when the actuating link (24) occupies the engine operation and shutdown positions, respectively. Externally applied forces on actuating link 24 are not transmitted directly to the engine stoppage member (19) since the spring (30) completes the movement of engagement apparatus (20) to first and second positions in response to movement of actuating link (24). Consequently, no damage occurs to stoppage member (19) but engine stoppage is assured.

7 Claims, 10 Drawing Figures

FIG_1_
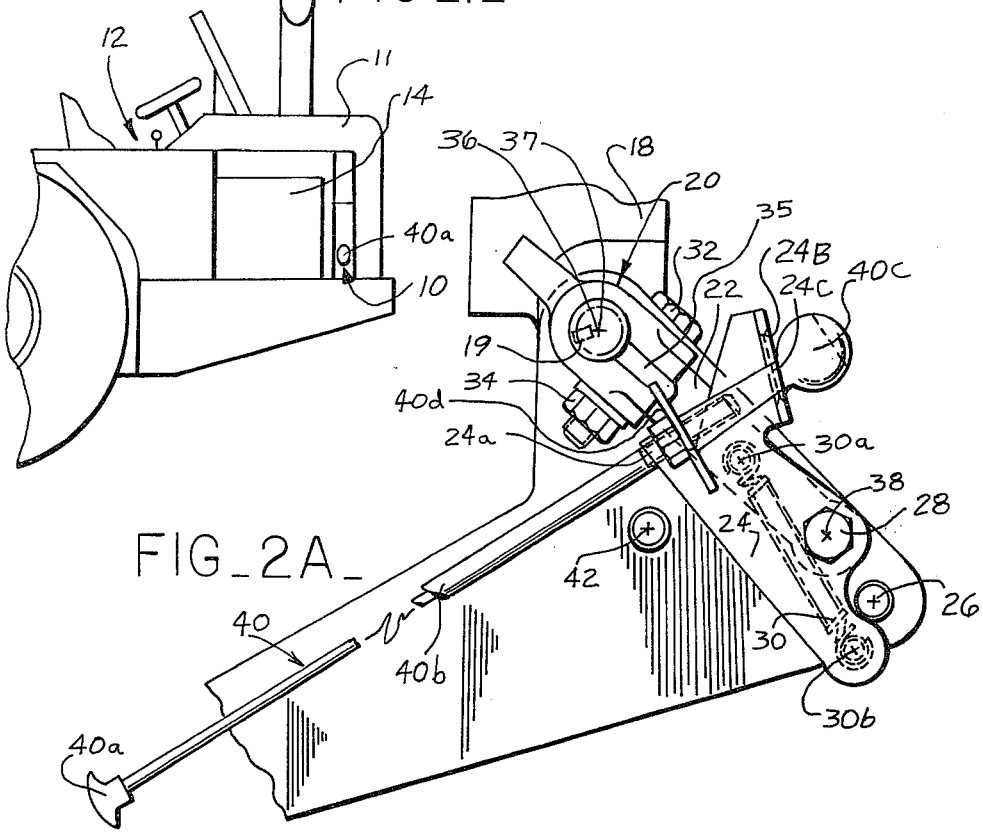
FIG_2A_
FIG_2B_
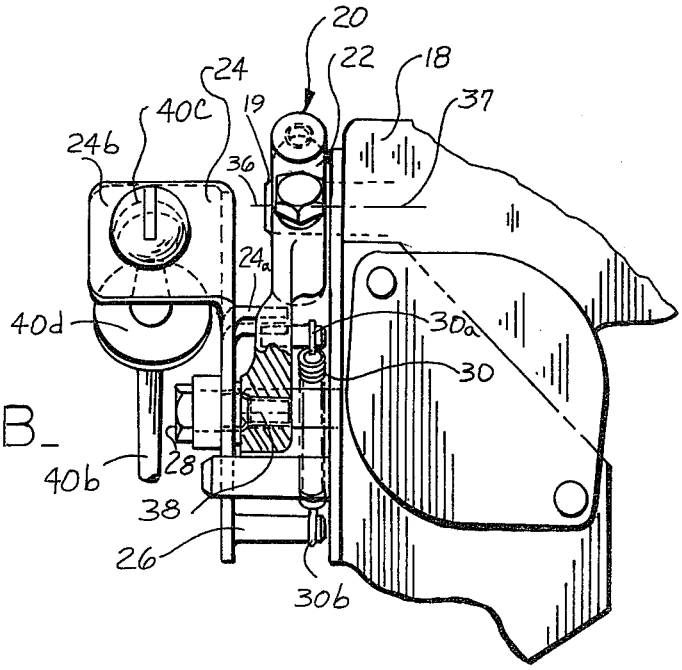

AUXILIARY ENGINE STOPPAGE APPARATUS

DESCRIPTION

1. Technical Field

This invention relates to engines, and more particularly, to means for insuring engine stoppage by application of a momentary force thereto.

2. Background Art

Numerous techniques exist for stopping an engine in the normal course of operation such as valving off a fuel line at any one of several possible locations and reducing the engine speed below that necessary to maintain operation. On industrial engines it is common practice to include a governor or engine speed maintaining device which adjusts the quantity of fuel sent to the engine combustion chambers so as to maintain constant engine RPM for various loads imposed thereon. The governor usually has a shut-off member which, when moved from an operational position to a shut-off position, halts the engine by overriding the governor's spring which is used to maintain the speed of the engine. The governor shut-off members are typically activated by electrically actuated solenoids or other displacement devices whose control is accessible from the engine operator's work station.

Adverse circumstances sometimes occur that necessitate engine stoppage from a location remote from the operator's work station. Such circumstances include emergency conditions where the controls to the normal shut-off activation devices are inaccessible or inoperative. When such adverse conditions arise, it has been found desirable to have an auxiliary engine stoppage device accessible from a location spacially separated from the operator's work station.

A device used heretofore for remotely stopping an engine constituted a flexible cable which was attached to the engine's governor shut-off member. Stoppage of an engine so equipped required cable withdrawal and securement thereof in the withdrawn position until the engine revolutions gradually slowed and the engine shutdown. Securement of the cable in such withdrawn position was necessary since, without such securement, the engine governor's own spring for maintaining the operator-selected speed would retract the cable and again maintain the engine in the operational mode. In an emergency situation it was found to be impractical for one to hold such cable in a withdrawn position except for a very short period of time. Additionally, excessive force on the cable sometimes damaged the cable and/or other governor components since the cable was connected directly to the governor shut-off member. As such, the previously-used device had some characteristics which proved disadvantageous.

More recently, a cable and latching mechanism were used in concert to stop the engine by withdrawing a flexible cable which displaced the governor shut-off member to a shutdown position and then latching the cable in the withdrawn position to prevent retraction of the cable and return of the governor shut-off member to the operational position by the governor spring. Such latching mechanism must, by necessity, be installed in an easily accessible location which typically means it is subjected to weather and other adverse elements which could reduce the latch mechanism's operability. Furthermore, use of such latching mechanism did not eliminate the possibility of governor damage when the flexible cable was rapidly withdrawn such as during an emergency situation. Accordingly, the present invention is intended to overcome one or more of the aforementioned problems.

DISCLOSURE OF THE INVENTION

In accordance with the present invention an auxiliary apparatus for stopping an engine is provided in association with a governor apparatus having an engine stoppage member which may be moved between engine operation and engine shutdown positions. The present invention generally includes a stationary frame member, an actuating link which is in sliding engagement with the frame member and is displaceable between operational and shutdown positions, and an engagement apparatus which is attached to the engine stoppage member and is displaceable to operational and shutdown positions when the actuating link occupies operation and shutdown positions, respectively. The engagement apparatus and actuating links are pivotally connected and an arrangement is included for biasing the engagement apparatus to the operational and shutdown positions when the actuating link is displaced to its operational and shutdown positions, respectively. The present invention assures engine stoppage when the actuating link is moved to its engine stoppage position while damage to the governor apparatus is prevented. Furthermore, the engine operator needs only apply a momentary force to the actuating link to move the engine stoppage member to its shutdown position without requiring continued operator presence and force application to the engine stoppage member until engine shutdown is achieved.

BRIEF DESCRIPTION OF THE DRAWINGS

The advantages of the present invention will become apparent from the following description when read in conjunction with the accompanying drawings in which:

FIG. 1 is a side elevational view of a scraper tractor apparatus in which the invention is exemplified;

FIG. 2*a* is a front elevational view of a first, engine operating configuration of the present invention;

FIG. 2*b* is a side elevational view of FIG. 2*a;*

BEST MODE FOR CARRYING OUT THE INVENTION

Figure 3A:
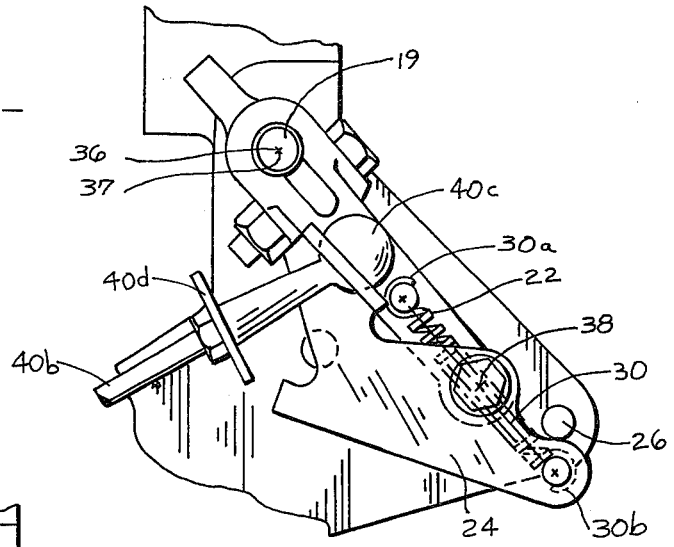
FIG. 3*a* is a front elevational view of an intermediate configuration of the present invention.

Referring now to the drawings in detail, an engine stoppage apparatus 10, embodying the principles of the present invention, is shown in FIG. 1 in association with a scraper tractor 11 which includes an operator work station 12 and an engine compartment 14 which houses an engine (not shown). A governor 18 (illustrated in FIGS. *2a–6b*) is mounted on the engine and includes an engine stoppage member or stoppage shaft 19.

The engine stoppage apparatus 10, better illustrated in FIGS. *2a–6b*, has an engagement apparatus 20 (including an engagement link 22), an actuating link 24, a first stationary frame member or pin 26, means such as an interconnecting bolt 28 for pivotally connecting the actuating link 24 and the engagement link 22, and means such as a spring 30 for biasing the engagement link 22 to operational and shutdown positions. Spring 30 has first and second ends 30*a* and 30*b* which are respectively connected to the engagement link 22 and the actuating link 24. Radial engagement between the engagement link 22 and stoppage shaft 19 is provided by a bolt and nut, 32 and 34, respectively, which transversely compress engagement link 22 across an opening 35 formed therein. Engagement link 22 is pivotable about a primary axis 36 and stoppage shaft 19 is rotatable about an axis 37 which is coaxially arranged with primary axis 36. Engagement link 22 and stoppage shaft 19 are arcuately displaceable between a first, engine operation position illustrated in FIGS. *2a* and *2b* and a second, engine shutdown position which is illustrated in FIG. *3b*. Interconnecting bolt 28 causes engagement link 22 and actuating link 24 to pivot about a secondary axis of rotation 38. Actuating link 24 is in sliding engagement with stationary pin 26 so as to cause actuating link 24 to slide thereagainst during its pivotal movement about secondary axis 38. Actuating link 24 includes a stopping segment 24*a* which restricts its movement beyond the first position by abutting engagement link 22 when the engagement link 22 is in the first, engine operation position. Actuating link 24 further includes an activating appendage 24*b* which has an opening 24*c* of predetermined size extending therethrough.

An extension assembly 40 is preferably used to exert an external force on actuating link 24 through its activating appendage 24*b*. Such extension assembly 40 includes a "T" handle 40*a* which is graspable from a location remote to the operator's work station 12 as seen in FIG. 1. Extension assembly 40 also includes an elongated element such as a flexible push-pull cable 40*b* which is joined to "T" handle 40*a* and extends through opening 24*c*. A first and a second abutting element 40*c* and 40*d*, respectively, are joined to flexible push-pull cable 40*b* on opposite sides of opening 24*c* and respectively constitute a spherical and an annular shaped member both of which are larger than opening 24*c* so as to preclude their passage therethrough. A second stationary frame member or stop pin 42 acts as a stopping member to prevent pivoting motion of engagement link 22 beyond the predetermined second or engine shutdown position which is better illustrated in FIG. *3b*. The flexible push-pull cable 40*b* is guided through a protective sheath (not shown for the sake of clarity) which is firmly attached to a stationary frame member.

FIGS. *5a* and *5b* illustrate an alternate embodiment of the present invention which provides an auxiliary engine stoppage apparatus 10'. In the following description thereof it is to be understood that elements like those described in the preferred embodiment are indicated by like reference numerals but with a prime character added. Governor 18 includes stoppage member or stoppage shaft 19 which is rotatable about stationary axis 37. An engagement apparatus 20' includes an engagement link 22' and a bushing 44 which is secured to engagement link 22'. A pin 46 is disposed through bushing 44 in rotatable sliding engagement therewith and a frame member 48 such that bushing 44 and engagement link 22' are pivotable about a primary stationary axis 36 which is coaxially arranged with pin 46. Engagement apparatus 20' further includes a translatable plunger 50 and a torquing member 52. Plunger 50 is guidable through frame member 48 and is abuttably engageable with engagement link 22'. A torquing member 52 is in radial engagement with stoppage shaft 19 about axis 37 and has a radial extension 54 with circumferential sides 54*a*,54*b*. A first end 50*a* of plunger 50 is engageable with engagement link 22' and a second end 50*b* of plunger 50 is engageable with circumferential side 54*a* of torquing member 52. Engagement link 22' and attached bushing member 44 are also pivotable about the secondary axis 38 about which pin 28' is disposed. A second radial extension 56 of torquing member 52 has circumferential sides 56*a*,56*b*.

An actuating link 24' has a pair of legs 24*a'* and 24*b'*, an opening 24*c'* therethrough, and a steeply ramped locking notch 24*d'* within which pin 26 may be captured. A pin 28' extends through legs 24*a'* and 24*b'* as well as engagement link 22' which is sandwiched therebetween so as to provide a pivoting motion between the actuating and engagement links 24' and 22' respectively. As illustrated in FIGS. *5a* and *5b*, a first spring attachment pin 33 extends through actuating link 24' while a second spring attachment pin 39 extends through engagement link 22' wherein such spring attachment pins are joined at each end by a spring 30. Actuating link legs 24*a'* and 24*b'* as well as engagement link 22' are disposed between the two springs 30 and are thus pivotable in a plane parallel to the springs.

An extension assembly 40' through which actuating link 24' is activatable includes a "T" handle 40*a*, a flexible push-pull cable 40*b*, a hemispherically enlarged abutting member 40*c'*, and an annular shaped, enlarged abutting member 40*d*. Abutting members 40*c'* and 40*d* are joined to flexible push-pull cable 40*b* on opposite sides of an opening 24*c* in actuating link 24'. Abutting members 40*c'* and 40*d* are larger than opening 24*c* so as to preclude their passage therethrough for travel in either direction of flexible cable 40*b*.

Industrial Applicability

Engine stoppage apparatus 10 is illustrated in FIGS. *2a* and *2b* in the first, engine operation configuration. When it is desired to stop the engine in question, "T" handle 40*a* is withdrawn in a direction toward the lower left of FIG. *2a*. Upon such withdrawal, flexible push-pull cable 40*b* and abutting elements 40*c*,40*d* are also displaced in a direction generally toward the lower left of FIG. *2a*. Such direction of cable withdrawal will hereafter be referred to as the first direction.

First abutting member 40*c* engages the activating appendage 24*b* at some point during its travel in the first direction. Further movement of abutting member 40*c* in the first direction causes a simultaneous displacement of activating appendage 24*b* in the first direction and a sliding motion of actuating link 24 against pin 26. Such simultaneous motion of actuating link 24 causes the interconnecting bolt 28 to be pivoted in a generally clockwise direction relative to primary axis 36. Since bolt 28 connects actuating link 24 and engagement link 22 about secondary axis 38, engagement link 22 is also caused to pivot about primary axis 36 in a generally clockwise direction. As motion in the first direction is continued, spring ends 30*a*,30*b* are increasingly separated so as to gradually elongate spring 30 and provide increasing biasing force on engagement link 22 to induce it to return to its operational position. Such return biasing continues until the configuration of FIG. 3*a* obtains wherein the spring 30 is at its maximum extension and secondary axis 38 is aligned with the ends 30*a*,30*b* of spring 30. Any further movement of actuating link 24 in the first direction causes bolt 28 to move out of alignment and permit spring 30 to bias engagement link 22 to a shutdown position.

Figure 3B:
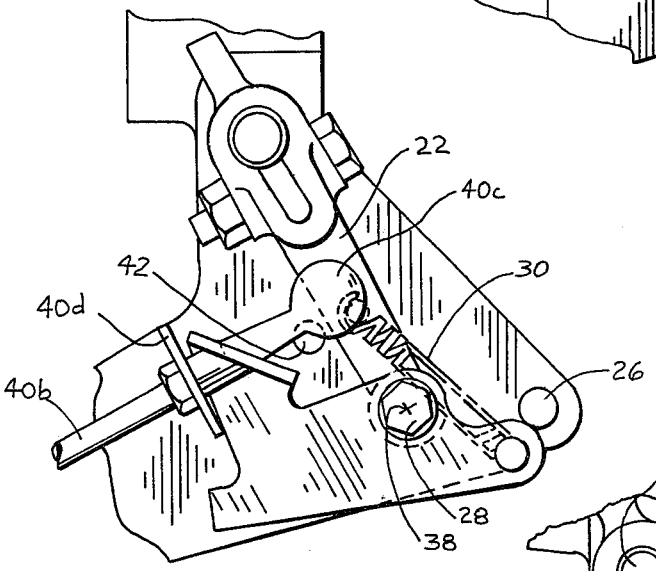
FIG. 3*b* is a front elevational view of a second, engine stopping configuration of the present invention.

The second or engine stoppage configuration of engine stoppage apparatus 10 is illustrated in FIG. 3*b* wherein stoppage shaft 19 has been rotated in a clockwise direction to its engine stoppage position and engagement link 22 which is connected therewith has pivoted about axis 36 into contact with stop pin 42 or to the maximum rotation position of shaft 19 depending on the design of the governor. As a result, the motion of interconnecting bolt 28 which extends through actuating link 24 and engagement link 22 is stopped. Since actuating link 24 remains in sliding contact with pin 26 and bolt 28 is motionless, actuating link 24 is also brought to rest in its second, engine stoppage position. Thus, when secondary axis 38 and coaxially arranged bolt 28 are situated on a first or operational side of a line connecting spring ends 30*a*,30*b*, the spring 30 biases the engagement link 22 to the operational position. However, when secondary axis 38 and bolt 28 are situated on a second or shutdown side of a line connecting the spring ends, the engagement link 22 is biased to the shutdown position as illustrated in FIG. 3*b*. The aforementioned kinematic behavior tends to lock the engine stoppage apparatus 10 in one of the two stable positions - operational or shutdown.

When it is desired to restart the subject engine, extension assembly 40 is again activated by pushing on or otherwise retracting "T" handle 40*a*. Such retraction causes the second abutting member 40*d* to move in a second direction (opposite that of the first direction) and abut activating appendage 24*b*. Continued movement of abutting member 40*d* in a direction to the upper right of FIG. 2*a* (second direction) causes actuating link 24 to pivot in a generally clockwise direction since it is in sliding engagement with stationary pin 26. Interconnecting bolt 28 continues to move in a generally counterclockwise direction relative to primary axis 36 until the present invention's configuration illustrated in FIG. 3*a* obtains. Further movement of "T" handle 40*a* in the second direction causes spring 30 to drive the actuating link 24 and engagement link 22 to their operational positions wherein the engine stoppage apparatus 10 assumes the engine operation configuration. Displacement of the engine stoppage apparatus 10 in the second direction is stopped by abutment of stopping segment 24*a* of actuating link 24 against engagement link 22. When stopping segment 24*a* engages engagement link 22 and actuating link 24 is in sliding engagement with pin 26, further relative movement between actuating link 24 and engagement link 22 is precluded. Thereafter, link 24 and link 22 act in concert as a single unit which is free to move with shaft 19 between its operation and shutdown positions independent of extension assembly 40 and in response to forces from sources other than extension assembly 40 as hereinafter described.

Figure 4:
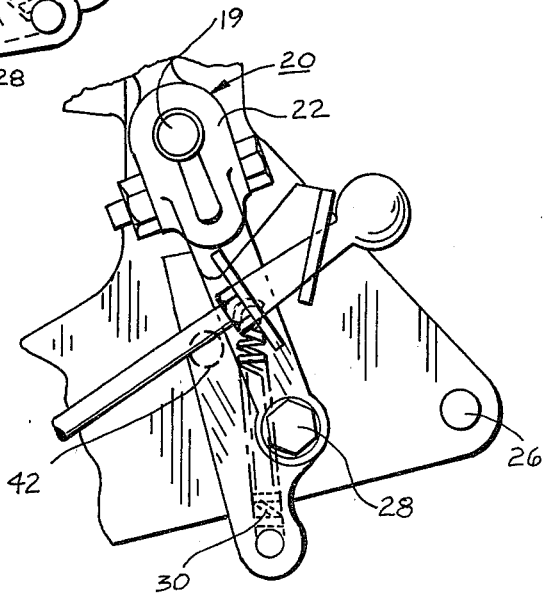
FIG. 4 is a front elevational view of the present invention occupying a configuration to which the invention has been moved by other means.

FIG. 4 illustrates the configuration of engine stoppage apparatus 10 resulting from stopping the engine in a normal mode such as by an electric solenoid or other device which is routinely activated to halt the engine. Actuating link 24 pivots with engagement link 22 away from stationary pin 26 when the engine stoppage shaft 19 is rotated by such routinely activated engine stoppage means. As such, the auxiliary engine stoppage apparatus 10 permits free movement of stoppage shaft 19 by normal shutdown means by allowing actuating link 24 to be rotated out of contact with pin 26.

Figure 5A:
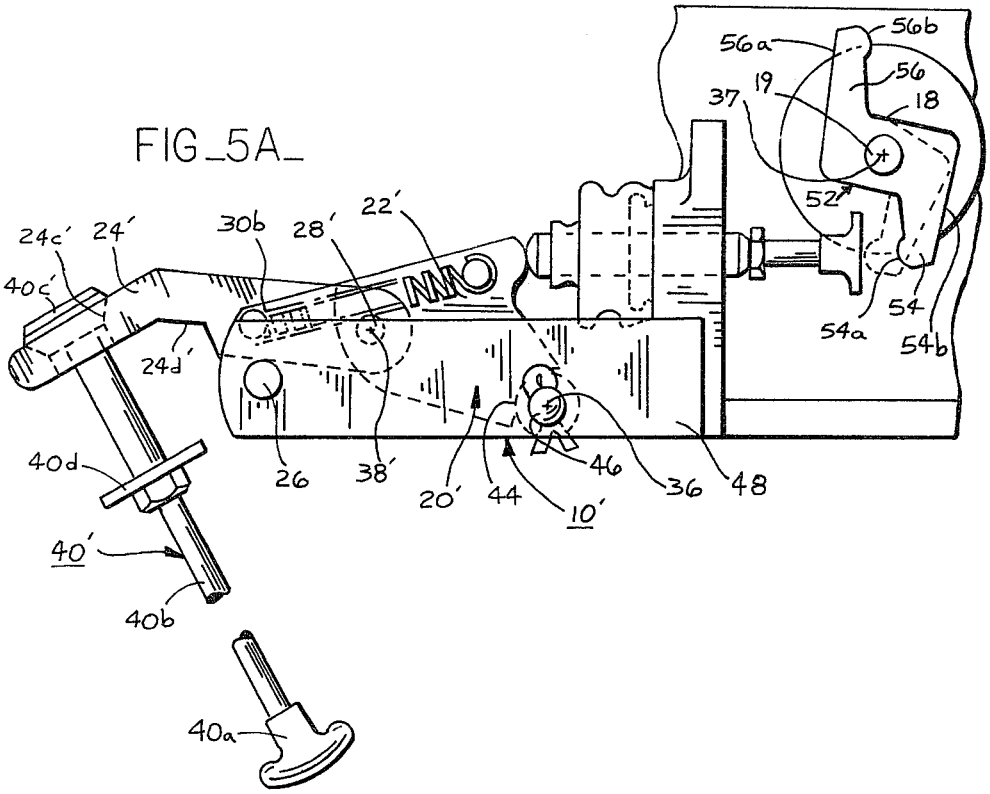
FIG. 5*a* is a front elevational view of a first, engine operating configuration of an alternate embodiment of the present invention.
Figure 5B:
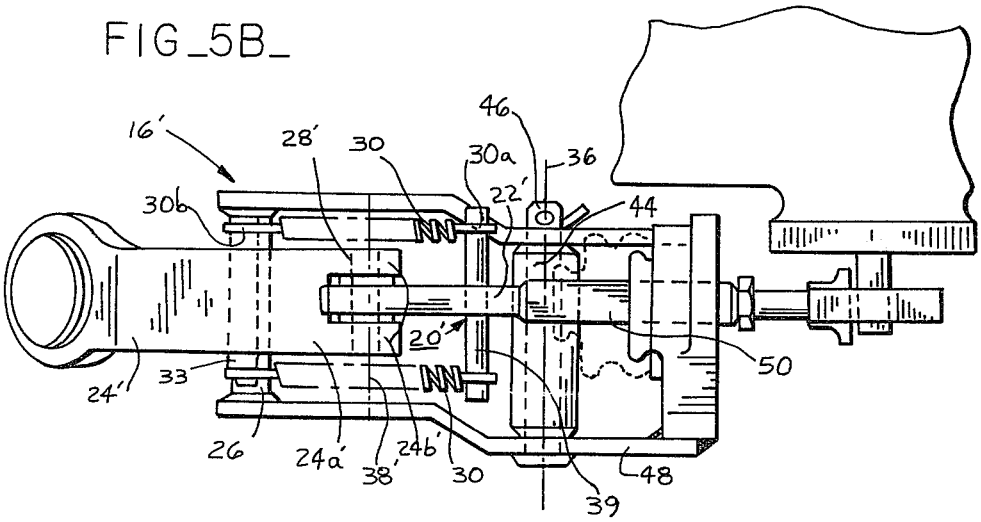
FIG. 5*b* is a side elevational view of FIG. 5*a;*
Figure 6A:
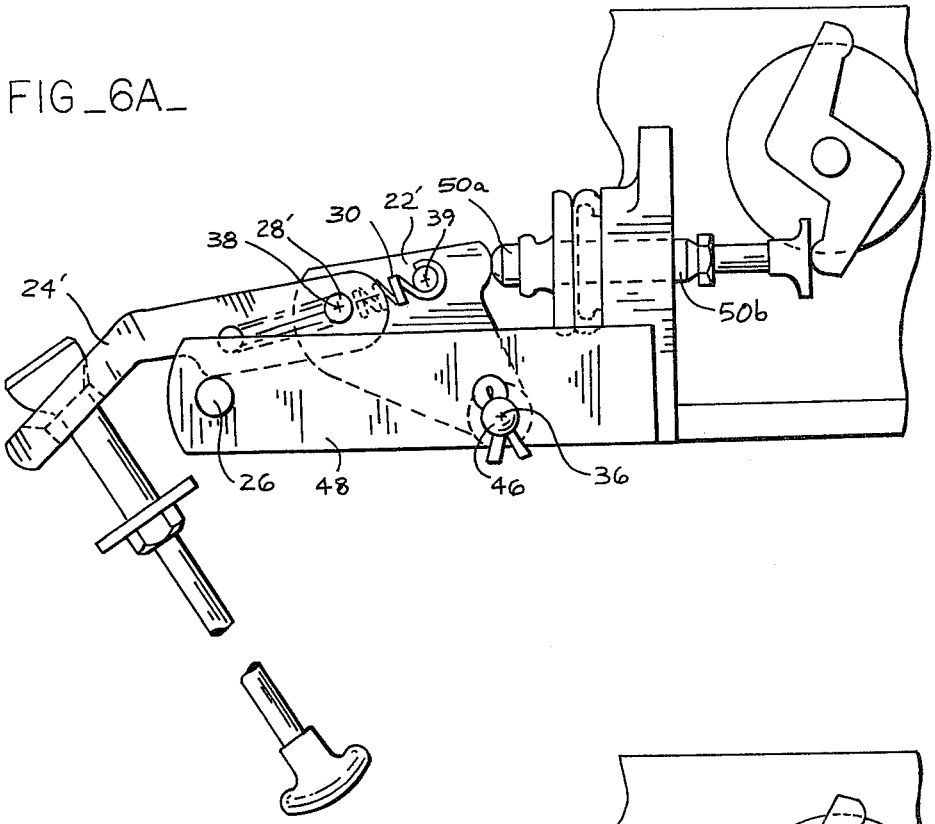
FIG. 6*a* is a front elevational view of an intermediate configuration of the alternate embodiment of the present invention.

FIGS. 5*a* and 5*b* illustrate alternate auxiliary engine stoppage apparatus 10' in the first, operational position. When "T" handle 40*a* is withdrawn, abutting member 40*c'* engages actuating link 24' causing it to simultaneously pivot about the secondary axis 38 and move in sliding engagement with pin 26. As actuating link 24' pivots in a counterclockwise direction about secondary axis 38, engagement link 22' is pivotably driven in a generally clockwise direction about primary axis 36 while springs 30 are stretched until their maximum extension is realized. Such maximum spring extension is illustrated in FIG. 6*a* and occurs when secondary axis 38 is aligned with spring ends 30*a* and 30*b*. As engagement link 22' rotates in a clockwise direction about primary axis 36, it abuts first plunger end 50*a* and causes it to move to the right when viewed from the vantage point of FIGS. 5*a*, 5*b*, and 6*a*. As the translatable plunger 50 translates to the right, its second end 50*b* engages circumferential side 54*a* of radial extension 54 so as to rotate torquing member 52 and cause engine stoppage shaft 19 which is engaged therewith to likewise rotate to a second, engine stoppage position.

Figure 6B:
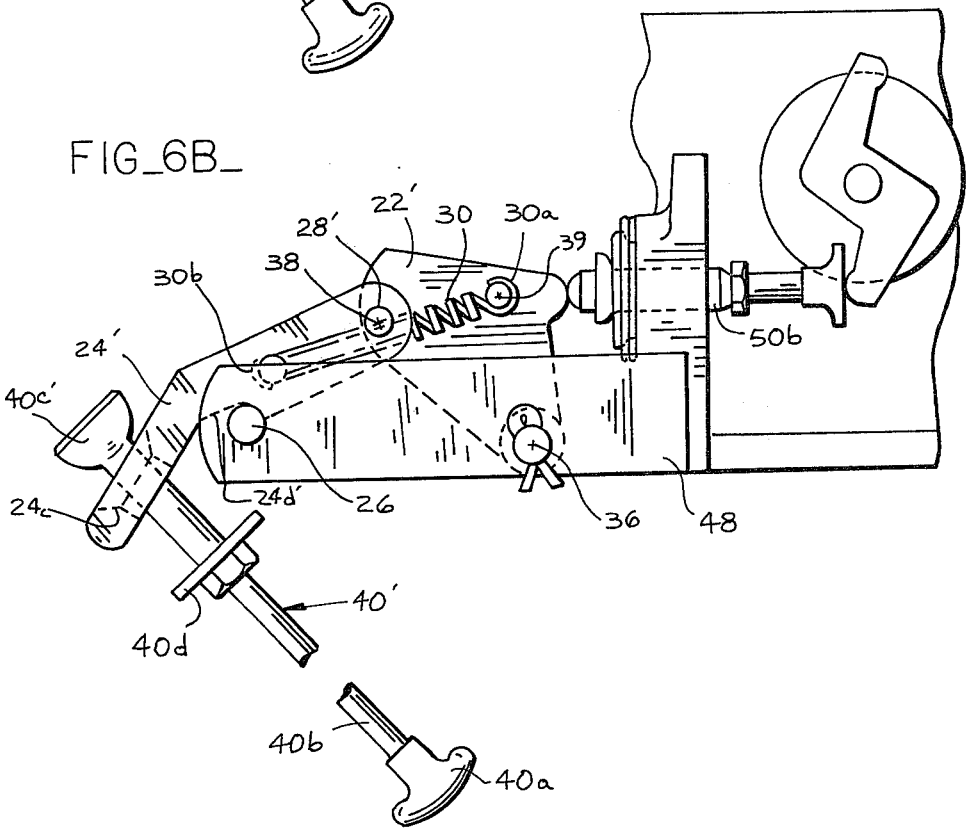
FIG. 6*b* is a front elevational view of a second, engine stopping configuration of the alternate embodiment of the present invention.

FIG. 6*b* illustrates the auxiliary engine stoppage apparatus 10' in the second, engine stoppage configuration. Movement of engine stoppage apparatus 10' from the configuration illustrated in FIG. 6*a* to that illustrated in FIG. 6*b* is compelled by springs 30 which complete the displacement of actuating link 24' and engagement apparatus 20' upon movement of pin 28' to a position slightly beyond alignment with spring ends 30*a*,30*b*. Subsequent urging by the governor 18 to return stoppage apparatus 10' to the configuration of FIG. 6*a* is resisted by the biasing force in springs 30 and the locking action obtained from disposition of pin 26 in the notch 24*d'* of actuating link 24'.

Normal engine stoppage is typically provided by an electric solenoid or other means which engage the circumferential side 56*b* of second radial extension 56 of torquing member 52 and cause it and stoppage shaft 19 to rotate in a counterclockwise direction. As such, auxiliary engine stoppage apparatus 10' does not restrict normal engine stoppage by the previously mentioned solenoid or other means when engine stoppage apparatus 10' is in its first, operating configuration as illustrated in FIGS. 5*a* and 5*b*.

Returning the engine stoppage apparatus 10' to its operational configuration requires only a push or other externally applied force on "T" handle 40*a* in a second direction opposite that with which it was withdrawn. Movement of the attached abutting member 40*d* in such second direction causes actuating link 24', when engaged by abutting member 40*d*, to pivot about secondary axis 38 and slide against stationary pin 26. The sliding motion of link 24' causes movement of interconnecting pin 28' and thus engagement link 22'. Movement of engagement link 22' is constrained to be pivotal about the primary axis 36. Such aforementioned cooperative movements continue until pin 28' and coaxially arranged secondary axis 38 move through and slightly beyond alignment with spring ends 30*a*,30*b*. At such time springs 30 cause actuating link 24' and engagement link 22′ to be driven to their operational positions with a force independant of the externally applied force. The rotative movement of engagement link 22′ allows plunger 50 to translate to the left and permit engine stoppage shaft 19 to assume its operational position.

When the aforementioned auxiliary engine stoppage apparatus 10 and 10′ are provided on devices such as earthmoving scrapers, the engine powering such devices can be shut down from a location remote from the operator's work station 12 in a positive manner which requires only momentary actuation and which avoids damage to the governor 18. The momentary actuation compels extension of at least one spring 30 which completes the movement of the governor stoppage shaft 19 to the engine shutdown position and prevents governor damage with suitable selection of spring constant and spring end attachment locations. All components of the engine stoppage apparatus 10 and 10′ are housed within the engine compartment 14 except for the "T" handle 40*a* which must be grasped by the operator or other person and must, by necessity, be readily accessible on the external side of the engine compartment 14. While such auxiliary engine stoppage apparatus 10 and 10′ may seldom, if ever, be utilized, its availability is extremely important since engine stoppage from a position remote from the operator's work station can reduce the hazard in stopping the engine and the expense which may be incurred in repairing the utilizing device if its engine cannot be readily stopped. Moreover, the auxiliary engine stoppage apparatus 10 and 10′ can easily be returned to the operational configuration with only a push on the "T" handle 40*a*. The engine stoppage apparatus 10 and 10′ also permit normal, end-of-the-day type engine stoppage from the operator work station 12 without interfering therewith.

It should now be apparent that an auxiliary engine stoppage apparatus has been provided which responds to a momentary activation by an operator by stopping the engine and, at the same time, avoiding governor damage and obviating the need for the operator's presence and his continued force application thereto in the vicinity of the engine stoppage apparatus.

I claim:

1. An auxiliary engine stoppage apparatus (10,10′) for an engine governor (18) having an engine stoppage member (19) which is arcuately displaceable between first and second positions which respectively permit engine operation and induce engine shutdown, said auxiliary engine stoppage apparatus (10,10′) comprising:

a first stationary frame member (26);

an actuating link (24,24′) in sliding engagement with said first frame member (26), said actuating link being displaceable by an external force between first and second positions;

an engagement apparatus (20,20′) joined to said engine stoppage member (19) for displacing said engine stoppage member (19) between its first and second positions in response to displacement of said actuating link (24,24′) between its first and second positions, respectively, said engagement apparatus (20,20′) including an engagement link (22,22′) which is pivotable about a stationary primary axis (36) and is displaceable between first and second positions which respectively correspond to engine operation and shutdown;

means for pivotably connecting (28,28′) said actuating link (24,24′) to said engagement link (22,22′) about a secondary axis (38), said pivotal connecting means (28,28′) being displaceable with said actuating link (24,24′) and said engagement link (22,22′); and means connecting said actuating link (24,24′) and said engagement link (22,22′) for biasing (30) said engagement link (22,22′) to said operational and shutdown positions with a predetermined, independent force when said actuating link (24,24′) occupies first and second positions, respectively.

2. The apparatus of claim 1 wherein said biasing means constitutes a spring (30) having first (30*a*) and second (30*b*) ends pivotally connected to said engagement link (22,22′) and said actuating link (24,24′) respectively, said spring (30) biasing said engagement link (22,22′) to said operational and shutdown positions when said pivotable connecting means (28,28′) is on first and second sides, respectively, of a line connecting said spring ends (30*a*,30*b*).

3. The apparatus of claim 1 further comprising:

a second stationary frame member (42) for restricting the motion of said engagement link (22) beyond said second position.

4. The apparatus of claim 1 wherein said actuating link (24) has a stopping segment (24*a*) which is engageable with said engagement link (22) and cooperates with said first frame member (26) to restrict said actuating link's (24) movement when said engagement link (22) is in said first position.

5. The apparatus of claim 1 further comprising:

an extension assembly (40,40′) having a graspable member (40*a*);

an elongated member (40*b*) joined to said graspable member and extending through an opening (24*c*) in said actuation link (24); and first (40*c*,40*c*′) and second (40*d*) abutting members disposed on opposite sides of said actuating link's opening (24*c*), said abutting members (40*c*,40*c*′,40*d*) being larger than said opening (24*c*) and being engageable with said actuating link (24) to provide displacement thereof during movement of said graspable member (40*a*) and elongated member (40*b*) in a first and a second direction, respectively.

6. The apparatus of claim 1 wherein said engine stoppage member (19) constitutes a shaft which has an axis of rotation coincidental with said primary axis (36) and is radially engageable with said engagement link (22) such that said shaft (19) is circumferentially displaceable when said engagement link (22) is pivoted about said primary axis (36).

7. The linkage of claim 1, said engagement apparatus further comprising:

a torquing member (52) radially engaged with said engine stoppage member (19), said torquing member (52) constituting at least one radial extension (54) having circumferential sides (54*a*,54*b*); and a translatable plunger (50) having first and second ends (50*a*,50*b*) respectively abuttable with said engagement link (22′) and a circumferential side (54*a*) of said radial extension (54) so as to arcuately displace said engine stoppage member (19) when said engagement link (22′) is pivoted about said primary axis (36).

* * * * *